US009188073B2

(12) United States Patent
Chen et al.

(10) Patent No.: US 9,188,073 B2
(45) Date of Patent: Nov. 17, 2015

(54) METHOD AND DEVICE FOR DIAGNOSING DEVIATIONS IN A SINGLE CYLINDER LAMBDA CONTROL

(75) Inventors: Lu Chen, Bietigheim-Bissingen (DE); Eberhard Schnaibel, Hemmingen (DE); Andreas Koring, Reutlingen (DE); Richard Holberg, Stuttgart (DE); Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 218 days.

(21) Appl. No.: 13/514,712

(22) PCT Filed: Nov. 5, 2010

(86) PCT No.: PCT/EP2010/066930

§ 371 (c)(1),
(2), (4) Date: Aug. 17, 2012

(87) PCT Pub. No.: WO2011/069760

PCT Pub. Date: Jun. 16, 2011

(65) Prior Publication Data

US 2013/0199283 A1 Aug. 8, 2013

(30) Foreign Application Priority Data

Dec. 8, 2009 (DE) ..... 10 2009 047 648

(51) Int. Cl.
*G01M 15/04* (2006.01)
*F02D 41/14* (2006.01)
*F02D 41/00* (2006.01)

(52) U.S. Cl.
CPC ..... *F02D 41/1454* (2013.01); *F02D 41/008* (2013.01); *F02D 41/1456* (2013.01); *F02D 41/1495* (2013.01); *F02D 41/0082* (2013.01); *F02D 2041/1432* (2013.01)

(58) Field of Classification Search
CPC ..... G01M 15/04
USPC ..... 73/23.31, 23.32, 114.69, 114.72, 73/114.77
See application file for complete search history.

(56) References Cited

U.S. PATENT DOCUMENTS 4,782,690 A 11/1988 Terasaka
4,886,028 A 12/1989 Uchinami et al.

(Continued)

FOREIGN PATENT DOCUMENTS

DE 102005061890 6/2007
JP 60218058 10/1985

(Continued)

OTHER PUBLICATIONS

PCT/EP2010/066930 International Search Report dated Mar. 4, 2011 (Translation and Original, 6 pages).

*Primary Examiner* — Eric S McCall
(74) *Attorney, Agent, or Firm* — Michael Best & Friedrich LLP

(57) ABSTRACT

The invention relates to a method and device for diagnosing deviations in a single cylinder lambda control in an internal combustion engine having at least two cylinders and an exhaust gas sensor designed as a broadband lambda sensor, wherein a pump current is evaluated by means of a pump cell and the pump current is used at least temporarily for an individual cylinder lambda control. According to the invention, a pump voltage or a pump voltage change is determined via the pump cell in addition to the pump current and the value is transmitted to a diagnosis apparatus. Deviations in the single cylinder lambda control can thus be better diagnosed without additional material expense according to the invention, which provides advantages in particular in respect of tightened rulemaking in on-board diagnosis. A preferred application of the method is the use in internal combustion engines having multi-bank exhaust systems.

19 Claims, 2 Drawing Sheets

(56) References Cited

U.S. PATENT DOCUMENTS

| | | | | |
|---|---|---|---|---|
| 4,938,194 | A | 7/1990 | Kato et al. | |
| 7,249,489 | B2 * | 7/2007 | Allmendinger | 73/23.31 |
| 7,461,536 | B2 * | 12/2008 | Schnaibel et al. | 73/1.06 |
| 2004/0149008 | A1 * | 8/2004 | Allmendinger | 73/23.31 |
| 2005/0217437 | A1 | 10/2005 | Whitehead et al. | |
| 2006/0027012 | A1 * | 2/2006 | Allmendinger | 73/23.31 |
| 2006/0137427 | A1 * | 6/2006 | Schnaibel et al. | 73/1.06 |
| 2006/0170538 | A1 | 8/2006 | Schnaibel et al. | |
| 2007/0261475 | A1 * | 11/2007 | Allmendinger | 73/31.01 |
| 2012/0167656 | A1 * | 7/2012 | Verdier et al. | 73/1.06 |
| 2012/0293183 | A1 * | 11/2012 | Ledermann | 324/543 |
| 2013/0186169 | A1 * | 7/2013 | Bevot et al. | 73/1.06 |

FOREIGN PATENT DOCUMENTS

| | | |
|---|---|---|
| JP | 1219328 | 9/1989 |
| WO | 2007031365 | 3/2007 |

* cited by examiner 60
120
NO
$O_2$
$O^{2-}$
$O_2$
63
62
150
61
67
66
68
160
69
64
150
60
110
HC
CO
$H_2$
$O^{2-}$
$O_2$
160
65
64

METHOD AND DEVICE FOR DIAGNOSING DEVIATIONS IN A SINGLE CYLINDER LAMBDA CONTROL

BACKGROUND OF THE DESCRIPTION

The invention relates to a method and device for diagnosing deviations in a single cylinder lambda control in an internal combustion engine having at least two cylinders and an exhaust gas sensor designed as a broadband lambda sensor, wherein a pump current is evaluated by means of a pump cell and said pump current is used at least temporarily for an individual cylinder lambda control.

A lambda control in combination with a catalytic converter is today the most effective emission control method for the Otto engine. The use of a three-way or selective catalytic converter is particularly effective. This kind of catalytic converter has the capacity to degrade hydrocarbons, carbon monoxide and nitrogen oxides up to more than 98% in the event that the engine is operated in a range of approximately 1% around the stoichiometric air-fuel ratio whereat $\lambda=1$. The lambda value thereby indicates how far the actual, present air-fuel mixture deviates from the value $\lambda=1$, which corresponds to a mass ratio of 14.7 kg air to 1 kg gasoline theoretically necessary for complete combustion, i.e. the lambda value is the quotient from the air mass supplied and the theoretically required amount of air. In the case of excess air, $\lambda>1$ (lean mixture). In the case of excess gasoline, $\lambda<1$ (rich mixture).

When a lambda control is being performed, the exhaust gas is measured and the fuel quantity supplied is immediately corrected in accordance with the measurement result by means of a fuel injection system.

Lambda probes are used as detecting elements, which can be designed on the one hand as a so-called two-point lambda probe or discrete-level sensor and on the other hand as a continuous lambda probe or broadband lambda probe. The effect of these lambda probes is based in a manner known per se on the principle of a galvanic oxygen concentration cell with a solid state electrolyte. The characteristic curve of a two-point lambda probe has a sharp drop in the probe voltage at $\lambda=1$. For that reason, a two-point lambda probe, which is usually mounted directly behind the exhaust manifold, essentially allows only for the distinction between rich and lean exhaust gas. On the other hand, a broadband lambda probe permits the exact measurement of the lambda value in the exhaust gas over a wide range around $\lambda=1$. Both types of lambda probe consist of a ceramic sensor element, a protective tube as well as cables, a plug and the connections between these elements. The protective tube consists of one or a plurality of metal cylinders having openings. Exhaust gas enters through said openings by means of diffusion or convection and travels to the sensor element. The sensor elements of the two types of lambda probes vary thereby in the construction thereof.

The sensor element of a two-point lambda probe consists of an oxygen ion-conductive electrolyte, in the interior of which a cavity filled with a reference gas is situated. The reference gas comprises a certain constant oxygen concentration but otherwise no oxidizing or reducing constituents. In many cases, the reference gas is air. Electrodes, which are connected to plug contacts via cables, are mounted on the outside of the electrolyte which is in contact with the exhaust gas as well as on the inside of the cavity. According to the Nernst principle, an electrical voltage occurs across the electrolyte, denoted below as Nernst voltage which is determined by the concentration of oxidizing and reducing exhaust gas components in the exhaust gas and in the reference gas. If besides oxygen there are no oxidizing or reducing exhaust gas components in the exhaust gas, the Nernst voltage is described by the equation $$U_{Nernst}=U_{Ref}-U_{Abgas}=(R*T/4*F)*In(p_{02,Ref}/p_{02,Abgas})$$

In this equation, $U_{Ref}$ stands for the electrical potential on the reference gas side, $U_{Abgas}$ for the potential on the exhaust gas side, $p_{02,Ref}$ and $p_{02,Abgas}$ for the oxygen partial pressure in the reference gas or respectively the exhaust gas, T for temperature, R for the general gas constant and F for the Faraday constant. The Nernst voltage can be tapped via the plug contacts and represents the signal of the two-point lambda probe.

The sensor element of a broadband lambda probe has an aperture on the surface, through which exhaust gas enters. A porous layer adjoins the inlet aperture, said exhaust gas diffusing through said porous layer into a cavity. Said cavity is separated from the external exhaust gas by an oxygen-ion conductive electrolyte material. Electrodes, which are connected to plug contacts via cables, are situated on the outside of the electrolyte as well as on the side of the cavity. The electrolyte situated between them is denoted as a pump cell. In addition, a reference gas having a certain constant oxygen concentration is situated in the interior of the sensor element, separated from the cavity by the same electrolyte material. An additional electrode, which is also connected to a plug contact, is situated in contact with the reference gas. The electrolyte between said additional electrode and the cavity side electrode is denoted as the measurement cell.

According to the Nernst principle, an electric voltage is applied across the measurement cell, which is referred to below as measurement voltage and is determined by the concentration of oxidizing and reducing exhaust gas components in the cavity and in the reference gas. Because the concentration in the reference gas is known and invariable, the dependence on the concentration in the cavity is reduced.

In order to operate the lambda probe, said probe must be connected via the plug to an evaluation unit, which, e.g., is situated in an engine control device. The measurement voltage is detected by the electrodes and transmitted to the evaluation unit. A control circuit is located in the control unit, said control circuit maintaining the voltage across the measurement cell to a set point value by a so-called pump current being driven through the pump cell. Because the current flow in the electrolyte takes place by means of oxygen ions, the oxygen concentration in the cavity is influenced. In order to maintain the measurement voltage at a constant level during steady-state operation, exactly as much oxygen has to be pumped out of the cavity during operation with a lean air-fuel ratio ($\lambda>1$) as diffuses through the diffusion barrier. On the other hand, during operation with a rich air-fuel ratio ($\lambda<1$) so much oxygen has to be pumped into the cavity that the diffusing, reducing exhaust gas molecules are compensated. While taking into account the fact that the oxygen balance in the cavity is maintained at a constant level by the pump current controller, a linear connection between the diffusion current, and thereby the pump current, and the oxygen concentration in the exhaust gas results from the diffusion equation. The pump current is now measured in the evaluation unit and transmitted to the main computer of the engine control device. It follows from that which is stated above that the pump current represents a linear signal for the oxygen balance in the exhaust gas. The connection between the lambda value and the oxygen balance is in fact non-linear, as the following equation proves.

$$i)C_{02,Abgas}=(1-1/\lambda)C_{02,Air} \quad (2)$$

The curvature of the curve is however sufficiently small in the region which is relevant for the engine control in order to permit an exact determination of the lambda value from the pump current.

Broadband lambda probes are, for example, known from the German patent publication DE 10 2005 061890 A1 as well as from the German patent publication DE 10 2005 043414 A1, wherein the publication DE 10 2005 061890 A1 describes the design of a broadband lambda probe, in which provision is made according to the invention for the use of certain chemical elements during the construction thereof.

In internal combustion engines comprising two or more cylinders, which discharge the exhaust gas into a exhaust manifold, the pipes of which open into a common exhaust pipe, the lambda values of the individual cylinders can vary either due to different air charges caused, for example, by pressure surges in the intake manifold or due to different fuel quantities caused, for example, by tolerances of the injection valve or due to a combination of both causes. Such individual cylinder lambda fluctuations can adversely affect the performance of the engine as described below.

If, for example, a three-way catalytic converter is installed in the exhaust gas pipe and the exhaust gas from the individual cylinders is unevenly distributed across the cross section of the catalytic converter, a satisfactory conversion of the exhaust gas is not possible. In a catalyst segment which is exposed to lean exhaust gas, the oxidizing exhaust gas components cannot be converted; whereas in a catalyst segment which is exposed to a rich exhaust gas, the reducing exhaust gas components cannot be converted. In addition, the efficiency decreases and the fuel consumption thereby increases if a complete combustion of the fuel does not take place in a cylinder operated with a rich air-fuel ratio. Furthermore, incompletely combusted fuel from the cylinders operated with a rich air-fuel ratio and excess air from the cylinders operated with a lean air-fuel mixture can after-react in the exhaust pipe. Energy is thereby released which can lead to a thermal overstressing of and even to damage to the components installed in the exhaust gas system, in particular the catalytic converter.

It is therefore desirable in a closed control circuit to not only adjust the mean lambda value of all the cylinders to a set point value but also said mean lambda value of each individual cylinder. Such a method is denoted below as an individual cylinder lambda control. In addition, the American on-board diagnostics regulations (OBD) for the model year 2011 require a detection of individual cylinder lambda fluctuations, which is also referred to below as out-of-tune diagnostics or fuel trim diagnostics.

Single cylinder lambda controls are already known from prior art. Thus, the German patent publication DE 102 60 721 A1, for example, describes a method and a device for diagnosing the dynamic properties of a lambda probe, which is used at least temporarily for an individual cylinder lambda control. The method is thereby characterized in that at least one manipulated variable of the lambda control is measured and compared with a predefinable maximum threshold. In the event of the maximum threshold being exceeded, the dynamic behavior of the lambda probe is evaluated as being insufficient with regard to usability for the individual cylinder lambda control.

Prior art or respectively the subject matter of earlier patent applications uses the lambda signal of a two point lambda probe or a broadband lambda probe for an out-of-tune diagnostics or an individual cylinder lambda control. In so doing, a number of difficulties arise.

One difficulty is that the relevant frequencies of the lambda signal are damped. A significant damping is caused by the protective tube. This problem relates to both two point as well as broadband lambda probes. In the case of a broadband lambda probe, still further damping effects can in fact be added, namely as a result of the diffusion barrier and as a result of the pump current regulator depending on the design thereof. All of the damping effects act in a cumulative way. Frequencies in the actual lambda value created by individual cylinder fluctuations can be damped in a speed range around 2000 rpm by over 50% by means of the diffusion barrier. At higher rotational speeds, the damping continues to increase. The signal-to-noise ratio worsens which impairs the out-of-tune diagnosis as well as the individual cylinder lambda control. Viewed in terms of damping, a two point lambda probe can therefore have advantages with respect to a broadband lambda probe in the range around $\lambda=1$.

A broadband lambda probe has however also advantages with respect to a two point lambda probe. One advantage is that a lambda control with a broadband lambda probe can constantly adjust the mean lambda to a set point value. In contrast, the typical method used with a two point lambda probe, the so-called two point control, causes an oscillation in the lambda probe signal and thus adjusts only the mean value over time to the set point value. The individual cylinder lambda fluctuations are superimposed by the much stronger oscillations resulting from the control intervention such that the detection is impaired.

In addition, a method is known, in which an observer algorithm for the individual cylinder lambda values is supported by the measured value of a broadband lambda probe. Because the observer algorithm is based on the model of the system, which has the individual cylinder lambda values as input variables and the lambda mean value as output variable, said algorithm will be referred to below as the model supported method. An important parameter for the observer algorithm is the operating point dependent dead time of the lambda probe. The method is thereby impaired in that the dead time varies with production bandwidth and ageing. In order to resolve this difficulty, a dead time adaption method is described, which is however likewise afflicted with disadvantages. An active fuel adjustment is thereby required for the adaption. In addition, said adaption can only insufficiently depict a possible operating point dependency of the dead time variation.

SUMMARY OF THE INVENTION

It is therefore the aim of the invention to provide a method and a device, which in using properties of an exhaust gas probe ensure a single cylinder lambda control and an improved out-of-tune diagnosis.

The aim of the invention which relates to the method is thereby met by the fact that a pump voltage or a pump voltage change is determined via the pump cell in addition to the pump current and said value is transmitted to the diagnosis apparatus. The advantage thereby is that the pump cell of the exhaust gas probe, which is designed as a broadband lambda probe, is operated in principle like a two point lambda probe, and the disadvantages with regard to the previously described damping during use of the broadband lambda probes do not affect the method. The out-of-tune diagnosis as well as the single cylinder control can thereby be optimized.

It is particularly advantageous if the pump voltage or the pump voltage change is evaluated in the diagnosis apparatus in combination with a regular lambda signal of the exhaust gas probe, which is designed as a broadband lambda probe, as is described below.

If a mean lambda value of all the cylinders is uniformly adjusted or adjusted close to 1 using the regular lambda signal of the exhaust gas probe and the signal of the pump voltage is evaluated, small individual cylinder fluctuations in the pump voltage can also be detected, which can be used in performing the out-of-tune diagnosis and the single cylinder diagnosis. This is the case because just as was true for the two point lambda probe, the dependency of the pump voltage in this lambda range on small fluctuations is especially strong.

With regard to an improved out-of-tune diagnosis, provision is made in a variant to the method for a filter having band-pass or differential characteristics to be applied to the measured signal of the pump voltage. Interfering signals can thereby be extensively suppressed because only the frequency ranges for the pump voltage are taken into account, which have been activated as a result of the individual cylinder lambda fluctuation.

In this connection, it has been proven to be advantageous if the transmission behavior of the filter is specified as a function of the operating point and is manipulated particularly as a function of the rotational speed of the internal combustion engine. A transmission function adapted to the rotational speed facilitates a dynamic adaptation of the frequency range, in which the individual cylinder lambda fluctuations can occur with the pump voltage signal.

With regard to an additionally improved suppression of interfering signals, provision can further be made for a correction term to be subtracted from the value of the gradient of the filtered signal of the pump voltage, said correction term being assumed on a model basis for an error-free system and being likewise predefined as a function of the operating point. The difference is then temporally integrated.

If a certain threshold value for the temporal integral is exceeded, an out-of-tune error is diagnosed, which can be entered into an error memory of an overriding engine control or displayed as a warning message. A robust out-of-tune diagnosis with respect to the future American on board diagnostics legislation can then be implemented.

Provision is made in a likewise preferred variant to the method for the temporal signal of the pump voltage to be subjected to a frequency analysis and for an out-of-tune diagnosis or a cylinder balancing to be performed on the basis of these frequency components ascertained during the frequency analysis. To meet this end, the temporal signal of the pump voltage is subjected to a Fourier analysis, and the amount of a motor play frequency and if need be integer multiples of the same are determined.

If the dead time or other dynamic parameters of the exhaust gas probe are ascertained by comparing the signal for the pump voltage with the regular lambda signal of said exhaust gas probe, model parameters of a model-supported cylinder balancing control can thereby be adapted on the basis of the regular lambda signal of said exhaust gas probe. Ageing effects of the sensor element of said exhaust gas probe can, for example, be taken into account during the cylinder balancing control.

A preferred application of the previously described method provides for the use thereof in internal combustion engines having multi-bank exhaust systems, in which the cylinders are subdivided into several groups and the exhaust gas of the different cylinder groups is conveyed into separate exhaust gas ducts.

The aim relating to the device is thereby met in that the previously described method can be implemented in the diagnosis apparatus and especially the signals of the pump voltage applied across the pump cell of the exhaust gas probe cab be evaluated.

BRIEF DESCRIPTION OF THE DRAWINGS

The invention is explained in detail below using the exemplary embodiments depicted in the figures. In the drawings.

DETAILED DESCRIPTION

Figure 1:
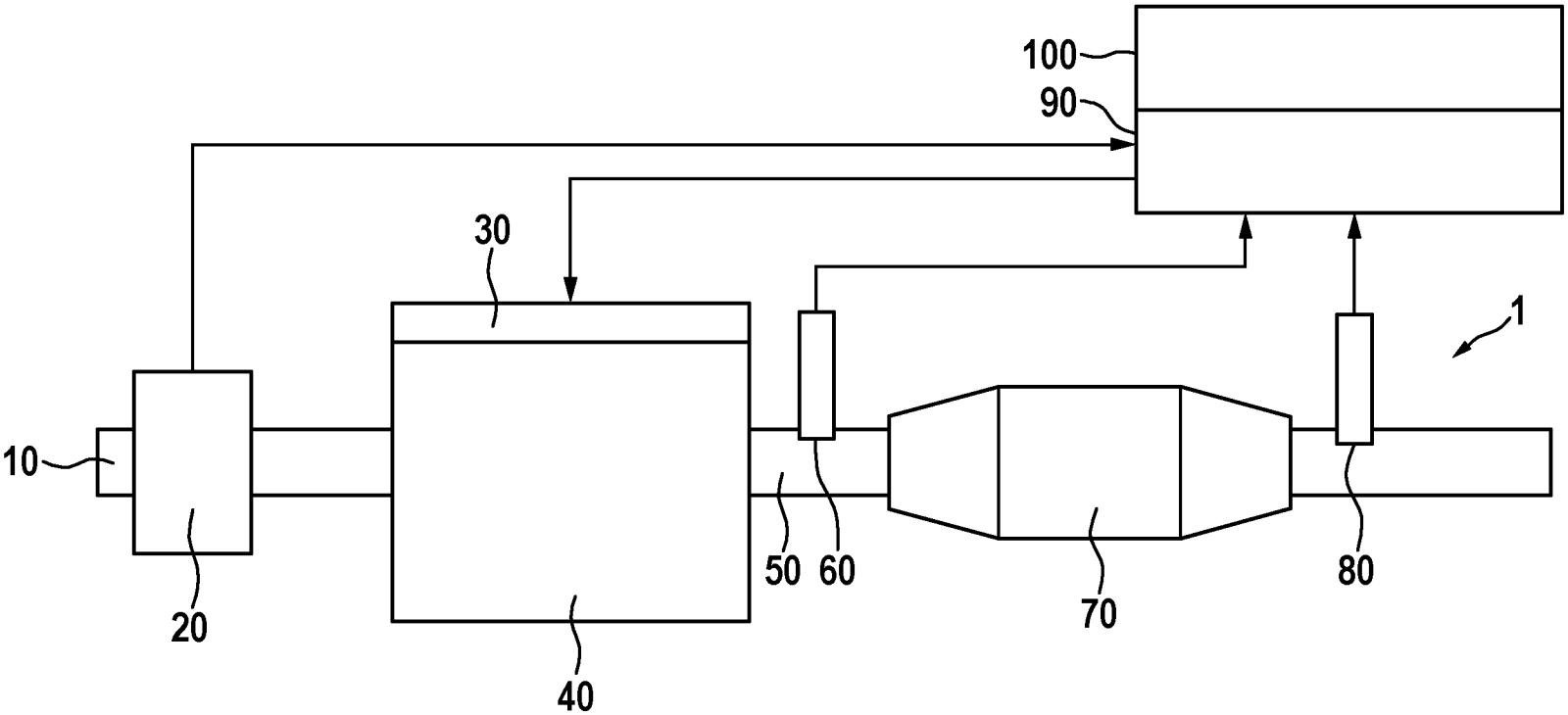
FIG. 1 shows a schematic depiction of an internal combustion engine.

FIG. 1 shows a technical environment by way of example, in which the method according to the invention can be applied. An internal combustion engine 1 comprising an engine block 40 and an air intake duct 10, which supplies the engine block 40 with combustion air, is depicted in the figure, wherein the air quantity in the air intake duct 10 can be determined with an air intake measuring device 20. The exhaust gas of the internal combustion engine 1 is thereby led across an emission control system which comprises an exhaust gas duct 50 as the main component, in which a first exhaust gas probe 60 is disposed upstream of a catalytic converter 70 and if applicable a second exhaust gas probe 80 is disposed downstream of said catalytic converter 70 in the direction of flow of the exhaust gas.

The exhaust gas probes 60, 80 are connected to a control unit 90 which calculates the mixture from data of said exhaust gas probes 60, 80 and the data of the air intake measuring device 20 and actuates a fuel metering device 30 for metering fuel. Provision is made for a diagnosis apparatus 100, with which the signals of the exhaust gas probes 60, 80 can be evaluated, to be coupled with or integrated into the control unit 90. The diagnosis apparatus 100 can additionally be connected to a display/memory unit, which is not depicted here. A lambda value, which is suitable for the emission control system to achieve an optimal purification effect, can be adjusted with the aid of said control unit 90 using the exhaust gas probe 60 disposed behind the engine block 40. The second exhaust gas probe 80 disposed downstream of the catalytic converter 70 in the exhaust gas duct 50 can also be evaluated in the control unit 90 and serves to determine the oxygen storage capacity of the emission control system in a method according to prior art.

An internal combustion engine 1 is exemplarily shown, which comprises only one exhaust gas duct 50. The inventive method however also applies to internal combustion engines 1 comprising multi-bank exhaust systems, in which the cylinders are subdivided into several groups and the exhaust gas of the different cylinder groups is conveyed into separate exhaust gas ducts 50.

Figures 2A, 2B:
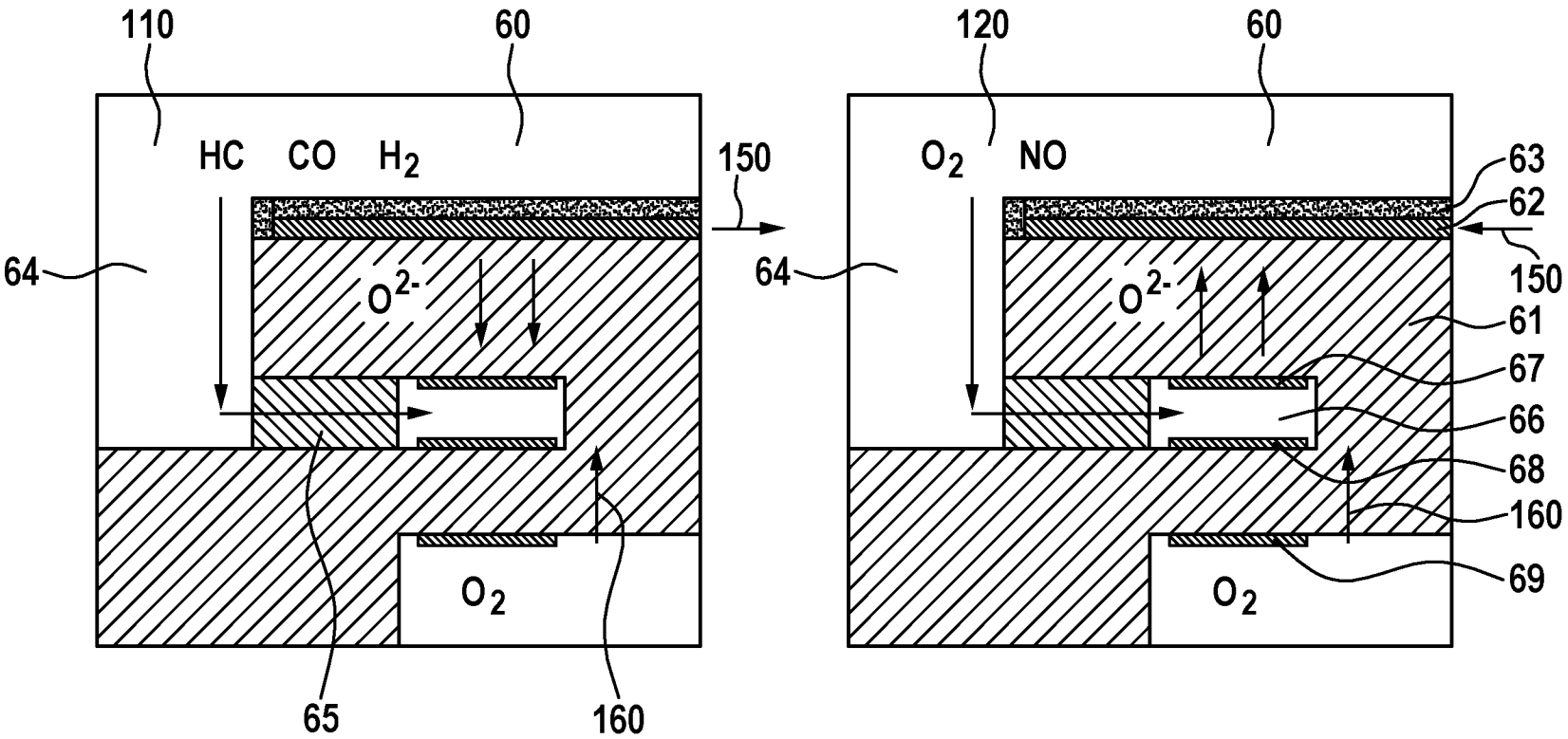
FIG. 2*a* and FIG. 2*b* show in a schematic depiction a broadband lambda probe as an exhaust gas probe at different exhaust gas compositions.

FIG. 2*a* and FIG. 2*b* show in schematic depiction an exhaust gas probe 60, which, as is provided for by the inventive method, is embodied as a broadband lambda probe and is exposed on the one hand to a rich exhaust gas 110 (FIG. 1*a*) and on the other hand to a lean exhaust gas 120 (FIG. 1*b*).

An exhaust gas probe 60, as said probe is, for example, described in the German patent publication DE 10 2005 061890 A1, comprises a pump cell having an outer electrode 62 and an inner electrode 67 as well as a measuring cell that includes a measuring electrode 68 and a reference electrode 69. The measuring electrode 68 and the reference electrode 69 are short-circuited. The exhaust gas probe 60 is normally designed in planar technology from several solid electrolyte layers 61. Provision is further made for a heating device, which is embedded in insulation and is used to heat the sensor element (not depicted in the figure). The exhaust gas 110, 120 can be delivered to a measuring chamber 66 via an opening 64 in the form of a bore and through a diffusion barrier 65. The inner electrode 67 of the pump cell as well as the measuring electrode 68 of the measuring cell is thereby disposed in the measuring chamber 66. The outer electrode 62 on the exterior side of the exhaust gas probe 60 facing the exhaust gas 110, 120 has a protective coating 63. The reference electrode 69 is disposed in a reference air duct, which is filled with ambient air.

A potential difference, the so-called Nernst voltage 160, is measured via the Nernst cell between the measuring electrode 68 and the reference electrode 69. A voltage is applied to the pump cell from the outside. Said voltage produces a current referred to as pump current 150, with which—as a function of polarity—oxygen ions are transported.

An electronic control circuit ensures that the pump cell always exactly delivers as much oxygen in the form of $O^2$ ions to the measuring chamber or conveys away as much oxygen in the form of $O^2$ ions from said measuring chamber 66 in order that a lambda value of $\lambda=1$ occurs, wherein oxygen is pumped out in the case of appliance lean exhaust gas 120 (excess air) and on the other hand oxygen is delivered in the case of appliance rich exhaust gas 110. The pump current 150 adjusted by the control circuit is dependent on the air ratio lambda in the exhaust gas and forms the output signal of the broadband lambda probe. In the case of lean exhaust gas 120, in which $O_2$ and also NO are present as the main components, the pump current 150 is positive and is negative in the case of rich exhaust gas 110 comprising CO, $H_2$ and HC (hydrocarbons).

In the case of an exhaust gas probe 60 designed as a broadband lambda probe, provision is made according to the invention for a pump voltage, which is applied across the pump cell, i.e. between the outer electrode 62 and the inner electrode 67, to be measured, to be transmitted to the control unit 90 and if applicable to be used in combination with the regular lambda signal, which is derived from the pump current 150, for the out-of-tune diagnosis or respectively for the single cylinder control.

The pump cell functions in this case like a two point lambda probe. One side is exposed to the exhaust gas 110, 120 and the other side to a reference gas, the composition of which is in fact not constant, said reference gas having however a constant Nernst potential. It is thus irrelevant that the constant Nernst potential is only set by means of the pump current 150. It must however be taken into account that in contrast to a two point lambda probe, a current flows through the pump cell. For that reason, the voltage across the pump cell does not correspond to the aforementioned Nernst equation (1) which describes a currentless electrolyte. On the contrary, a pump current regulator has to set a voltage in order to drive the pump current 150, said voltage being different from the aforementioned equation (1). The difference results from the pump current 150 and the internal resistance of the pump cell. Under the simplified assumption that no oxidizing or reducing exhaust gas components are present besides oxygen, the pump voltage is described by the following equation.

$$a)U_p=U_{Abgas}-U_{Hohlraum}=(R*T/4*F)*\ln(p_{O2,Abgas}/p_{O2,Hohlraum})+R_p*I_p \quad (3)$$

(a) Abgas=Exhaust Gas, Hohlraum=Cavity

In this equation $U_{Abgas}$ stands for the electrical potential on the exhaust gas side, $U_{Hohlraum}$ for the constantly maintained electrical potential on the cavity side or respectively in the measuring chamber 66, $p_{O2,Hohlraum}$ and $p_{O2,Abgas}$ for the oxygen partial pressure in the measuring chamber 66 or in the exhaust gas 110, 120. $R_p$ stands for the internal resistance of the pump cell, $I_p$ for the pump current 150 as well as T for the temperature, R for the general gas constant and F for the Faraday constant.

The electrical pump current direction is from the exhaust gas side to the cavity side. The oxygen ion current is thereby opposite to the electrical current direction as a result of the oxygen ions being negatively charged. Because even more oxygen ions have to be pumped, the richer the exhaust gas is, the pump current $I_p$ 150 increases with the oxygen concentration of the exhaust gas or respectively with the oxygen partial pressure $p_{O2,Abgas}$.

Provision is made in a further embodiment variant of the method with regard to an out-of-tune diagnosis in a single cylinder lambda control for a filter D having band-pass or differential characteristics to be applied to the measured pump voltage $U_p(t)$, said filter D allowing only frequencies of $U_p(t)$ to pass through which are activated by individual cylinder fluctuations. The transmission behavior of D can be a function of the operating point and can especially be dependent on the rotational speed of the internal combustion engine 1. A correction term is subtracted from the value of the gradient, said correction term corresponding to the gradient which is assumed as possible for an error-free system. K can likewise be a function of the operating point. In order to simplify the notations, the dependencies of D and K are however not explicitly presented below. For an error-free system, the difference between $D(U_p(t))$ and K would have to always be negative. Nevertheless, short-term interferences, which are not attributed to individual cylinder lambda fluctuations, can make said difference temporarily positive.

In order to achieve a robust out-of-tune diagnosis, an integral is formed from the difference between $D(U_p(t))$ and K having a lower limit of zero. This integral is to be denoted as W and is the diagnostic value of the out-of-tune diagnosis. The law of formation for W reads:

$$W(0)=0 \quad (4a)$$

and $$W(t+)t)=\max\{0,W(t)+)t*(*D(U_{p(t)})*-K)\} \quad (4b)$$

An out-of-tune error is diagnosed if W exceeds a certain threshold value.

Using the previously described variations of the method, deviations in the single cylinder lambda control can be better diagnosed without additional material expense, which is particularly advantageous with regard to stricter legislative regulations with regard to on board diagnostics.

The invention claimed is:

1. A method for diagnosing deviations in a single cylinder lambda control in an internal combustion engine (1) having at least two cylinders and an exhaust gas sensor (60), wherein a pump current (150) is determined and evaluated by means of a pump cell and said pump current is used at least temporarily for an individual cylinder lambda control, characterized in that a pump voltage is determined via the pump cell and a value of the pump voltage is transmitted to a deviation diagnosis apparatus (100).

2. The method according to claim 1, characterized in that the pump voltage is evaluated in combination with a lambda signal of the exhaust gas sensor (60) in the deviation diagnosis apparatus (100).

3. The method according to claim 1, characterized in that a dead time or other dynamic parameters of the exhaust gas sensor (60) are ascertained by comparison of a signal for the pump voltage with a lambda signal of the exhaust gas sensor (60).

4. The method according to claim 1 wherein the internal combustion engine (1) has multi-bank exhaust systems, in which cylinders are subdivided into several groups and an exhaust gas of the different cylinder groups is conveyed in separate exhaust gas ducts.

5. The method according to claim 1, characterized in that the exhaust gas sensor (60) is designed as a broadband lambda sensor.

6. The method according to claim 1, characterized in that a pump voltage change is determined via the pump cell and a value of the pump voltage change is transmitted to the deviation diagnosis apparatus (100).

7. The method according to claim 1, characterized in that a mean lambda value of all cylinders is adjusted using the lambda signal of the exhaust gas sensor (60), and the value of the pump voltage is evaluated.

8. The method according to claim 7, characterized in that the mean lambda value of all cylinders is uniformly adjusted.

9. The method according to claim 7, characterized in that the mean lambda value of all cylinders is adjusted close to 1.

10. The method according to claim 1, characterized in that a temporal signal of the pump voltage is subjected to a frequency analysis and a function is performed on the basis of frequency components ascertained during the frequency analysis.

11. The method according to claim 10, characterized in that the function is an out-of-tune diagnosis.

12. The method according to claim 10, characterized in that the function is a cylinder balancing.

13. The method according to claim 1, characterized in that a filter is applied to the value of the pump voltage.

14. The method according to claim 13, characterized in that a behavior of the filter is predefined as a function of an operating point and is modified as a function of a rotational speed of the internal combustion engine (1).

15. The method according to claim 13, characterized in that the filter has band-pass characteristics.

16. The method according to claim 13, characterized in that the filter has differential characteristics.

17. The method according to claim 13, characterized in that a correction term is subtracted from a value of a gradient of the filtered value, said correction term being assumed on a model basis for an error-free system and being predefined as a function of an operating point; a difference is then temporally integrated.

18. The method according to claim 17, characterized in that an out-of-tune error is diagnosed when a certain threshold value for the temporal integral has been exceeded.

19. An exhaust gas sensor (60) comprising:

a pump cell configured to determine and evaluate a PUMP current (150) and a pump voltage, said pump current used at least temporarily for an individual cylinder lambda control, and the exhaust gas sensor (60) transmitting a value of the PUMP voltage to a deviation diagnosis apparatus (100).

* * * * *